US011687019B2

(12) United States Patent
Mori et al.

(10) Patent No.: US 11,687,019 B2
(45) Date of Patent: Jun. 27, 2023

(54) FIXING DEVICE AND IMAGE FORMING APPARATUS

(71) Applicant: FUJIFILM Business Innovation Corp., Tokyo (JP)

(72) Inventors: Keitaro Mori, Kanagawa (JP); Toshiyuki Miyata, Kanagawa (JP); Kazuyoshi Itoh, Kanagawa (JP); Sou Morizaki, Kanagawa (JP); Kiyoshi Koyanagi, Kanagawa (JP); Motoharu Nakao, Kanagawa (JP); Toko Hara, Kanagawa (JP); Toru Inoue, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/489,817

(22) Filed: Sep. 30, 2021

(65) Prior Publication Data

US 2022/0382194 A1 Dec. 1, 2022

(30) Foreign Application Priority Data

May 25, 2021 (JP) ..... JP2021-087855

(51) Int. Cl.
*G03G 15/20* (2006.01)

(52) U.S. Cl.
CPC ..... *G03G 15/2053* (2013.01); *G03G 15/2017* (2013.01); *G03G 15/2064* (2013.01); *G03G 15/2057* (2013.01); *G03G 2215/2038* (2013.01)

(58) Field of Classification Search
CPC ..... G03G 15/2017; G03G 15/2053; G03G 15/2064; G03G 2215/2003
See application file for complete search history.

(56) References Cited

U.S. PATENT DOCUMENTS

2014/0138372 A1* 5/2014 Ogura ..... G03G 15/2042 399/329
2018/0356757 A1* 12/2018 Kobayashi ..... G03G 15/2053

FOREIGN PATENT DOCUMENTS

JP 2006078578 3/2006
JP 2006292867 10/2006

* cited by examiner

*Primary Examiner* — Thomas S Giampaolo, II
(74) *Attorney, Agent, or Firm* — JCIPRNET

(57) ABSTRACT

A fixing device includes a rotatable endless belt; a planar heat-generating section in which at least a downstream end portion in a movement direction of the belt is in pressure contact with a rotating body via a pressure contact portion and a cross-sectional shape of a downstream edge portion being in contact with an inner surface of the belt is formed in a curved shape having a curvature radius of 0.01 mm or more 0.2 mm or less or in a shape in which the edge portion is cut out over the dimension; and a holding section that is disposed inside the belt and holds the planar heat-generating section to be in pressure contact with the rotating body.

7 Claims, 10 Drawing Sheets

HEATER CURVATURE RADIUS R AND QUALITY

| | HEATER CURVATURE RADIUS R | | | | | |
|---|---|---|---|---|---|---|
| | 0.005 | 0.01 | 0.05 | 0.1 | 0.2 | 0.3 |
| IMAGE QUALITY = DISTORTION (SHAPE) CHANGE AMOUNT | ○ | ○ | ○ | ○ | △ | × |
| BELT RELIABILITY | × | ○ | ○ | ○ | ○ | ○ |

FIXING DEVICE AND IMAGE FORMING APPARATUS

CROSS-REFERENCE TO RELATED APPLICATIONS

This application is based on and claims priority under 35 USC 119 from Japanese Patent Application No. 2021-087855 filed May 25, 2021.

BACKGROUND

(i) Technical Field

The present invention relates to a fixing device and an image forming apparatus.

(ii) Related Art

In the related art, as techniques related to fixing devices, for example, fixing devices disclosed in JP2006-078578A, JP2006-292867A, or the like have already been proposed.

JP2006-078578A is configured such that, in a cross-section perpendicular to a rotation axis of an elastic roller, a center position of a plate-shaped heat-generating element is located upstream of the center of a nip portion in a transport direction of a recording material, a downstream end portion of the plate-shaped heat-generating element in the transport direction of the recording material is inside a nip of the nip portion, and an upstream end portion in the transport direction of the recording material is outside the nip of the fixing nip portion.

JP2006-292867A is configured such that the shape of an end face edge portion of a sliding portion of a protruding heating element is R0.2 or more.

SUMMARY

Aspects of non-limiting embodiments of the present disclosure relate to a fixing device and an image forming apparatus that makes a longer lifespan of a belt and improvement in image quality compatible with each other, as compared to a case where the cross-sectional shape of a downstream edge portion of a planar heat-generating section in a movement direction of the belt that is in pressure contact with an inner surface of the belt is formed into an arc shape having a curvature radius of 0.2 mm or more.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a rotatable endless belt; a planar heat-generating section in which at least a downstream end portion in a movement direction of the belt is in pressure contact with a rotating body via a pressure contact portion and a cross-sectional shape of a downstream edge portion being in contact with an inner surface of the belt is formed in a curved shape having a curvature radius of 0.01 mm or more and 0.2 mm or less or in a shape in which the edge portion is cut out over the dimension; and a holding section that is disposed inside the belt and holds the planar heat-generating section to be in pressure contact with the rotating body.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described with reference to the drawings.

Exemplary Embodiment 1

Figure 1:
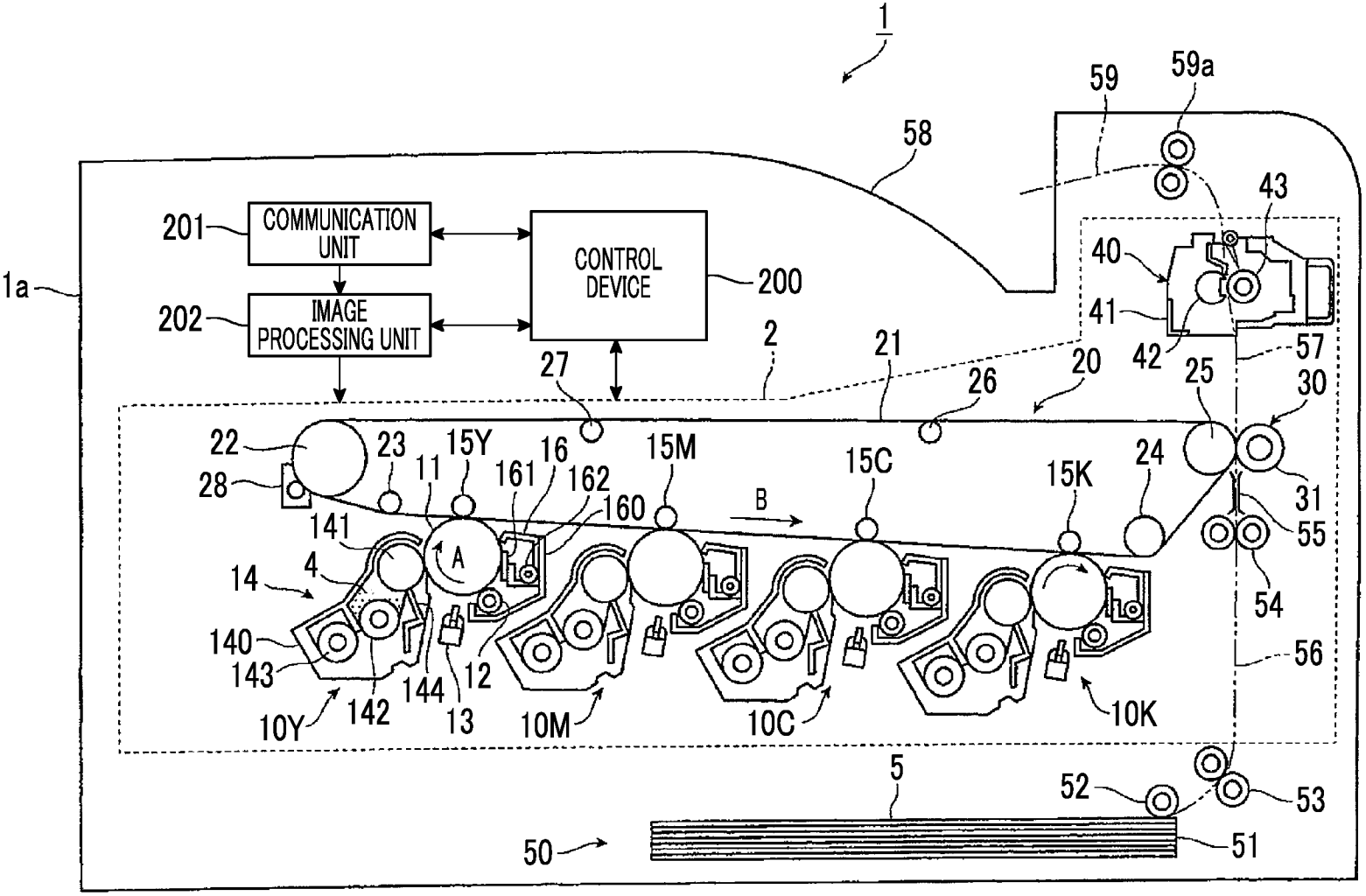
FIG. 1 is an overall configuration diagram showing an image forming apparatus to which a fixing device according to Exemplary Embodiment 1 of the present invention is applied.

FIG. 1 shows an image forming apparatus to which a fixing device according to Exemplary Embodiment 1 is applied.

Overall Configuration of Image Forming Apparatus

The image forming apparatus 1 according to Exemplary Embodiment 1 is configured as, for example, a color printer. The image forming apparatus 1 includes a plurality of image creating devices 10 that form toner images developed with a toner constituting a developer 4, an intermediate transfer device 20 that holds a toner image formed by each image creating device 10 and finally transports the held toner image to a secondary transfer position where the transported toner image is secondarily transferred to recording paper 5 serving as an example of a recording medium, a paper feed device 50 that accommodates and transports a required recording paper 5 to be supplied to the secondary transfer position of the intermediate transfer device 20, and a fixing device 40 that fixes the toner image on the recording paper 5 secondarily transferred by the intermediate transfer device 20. The plurality of image creating devices 10 and the intermediate transfer device 20 constitute an image forming section 2 that forms an image on the recording paper 5. In addition, 1*a* in the figure indicates an apparatus body of the image forming apparatus 1, and the apparatus body 1*a* is formed of a supporting structural member, an exterior cover, and the like. Additionally, a two-dot chain line in the figure indicates a transport route along which the recording paper 5 is transported in the apparatus body 1*a*.

The image creating device 10 includes four image creating devices 10Y, 10M, 10C, and 10K that exclusively form toner images in four colors of yellow (Y), magenta (M), cyan (C), and black (K), respectively. The four image creating devices 10 (Y, M, C, K) are disposed to be arranged in a row in an inclined state in an internal space of the apparatus body 1*a*.

The four image creating devices 10 include yellow (Y), magenta (M), and cyan (C) color image creating devices 10 (Y, M, C) and a black (K) image creating device 10K. The black image creating device 10K is disposed on the most downstream side along a movement direction B of the intermediate transfer belt 21 of the intermediate transfer device 20. The image forming apparatus 1 includes, as image forming modes, a full-color mode in which the color image creating devices 10 (Y, M, C) and the black (K) image creating device 10K are operated to form a full-color image, and a black-and-white mode in which only the black (K) image creating device 10K is operated to form a black-and-white (monochrome) image.

As shown in FIG. 1, each of the image creating devices 10 (Y, M, C, K) includes a rotating photoconductive drum 11 serving as an example of an image holder, and each device serving as an example of the following toner image forming section is disposed around the photoconductive drum 11. The devices are a charging device 12 that charges a peripheral surface (image holding surface) capable of forming an image on each photoconductive drum 11 to a required potential, an exposure device 13 that irradiates the charged peripheral surface of the photoconductive drum 11 with the light based on information (signal) of an image to form an electrostatic latent image (for each color) having a potential difference, a developing device 14 (Y, M, C, K) that develop the electrostatic latent image with a toner of a developer 4 for a corresponding color (Y, M, C, K) to form a toner image, a primary transfer device 15 (Y, M, C, K) that transfer each toner image to the intermediate transfer device 20, and a drum cleaning device 16 (Y, M, C, K) that remove and clean a deposit such as the toner remaining on and adhering to the image holding surface of the photoconductive drum 11 after the primary transfer.

The photoconductive drum 11 has an image holding surface having a photoconductive layer (photosensitive layer) made of a photosensitive material formed on a peripheral surface of a cylindrical or columnar base material to be subjected to ground treatment. The photoconductive drum 11 is supported such that power is transmitted thereto from a drive device (not shown) and the photoconductive drum 11 rotates in a direction indicated by arrow A.

The charging device 12 includes a contact type charging roll that is disposed in contact with the photoconductive drum 11. A charging voltage is supplied to the charging device 12. As the charging voltage, in a case where the developing device 14 performs reverse development, a voltage or current having the same polarity as the charging polarity of the toner supplied from the developing device 14 is supplied. In addition, as the charging device 12, a non-contact type charging device such as a scorotron disposed on the surface of the photoconductive drum 11 in a non-contact state may be used.

The exposure device 13 consists of an LED printhead that irradiates the photoconductive drum 11 with the light according to the image information by a plurality of light emitting diodes (LEDs) serving as a plurality of light emitting elements arranged in an axial direction of the photoconductive drum 11 to form an electrostatic latent image. In addition, as the exposure device 13, one that deflects and scans a laser beam configured in accordance with the image information in the axial direction of the photoconductive drum 11 may be used.

All of the developing devices 14 (Y, M, C, K) are configured such that a developing roll 141 that holds the developer 4 to transport the developer 4 to a developing region that faces the photoconductive drum 11, agitating and transporting members 142 and 143 such as two screw augers that transports the developer 4 to pass through the developing roll 141 while agitating the developer 4, a layer thickness regulating member 144 that regulates the amount (layer thickness) of the developer held on the developing roll 141, and the like are disposed inside a housing 140 in which an opening portion and an accommodation chamber of the developer are formed. A developing voltage is supplied to the developing device 14 from a power supply device (not shown) between the developing roll 141 and the photoconductive drum 11. Additionally, the developing roll 141 and the agitating and transporting members 142 and 143 rotate in a required direction by transmitting power from the drive device (not shown). Moreover, as the four-color developers 4 (Y, M, C, K), two-component developers containing a non-magnetic toner and a magnetic carrier are used.

The primary transfer device 15 (Y, M, C, K) is a contact type transfer device including a primary transfer roll that rotates around the photoconductive drum 11 in contact therewith via the intermediate transfer belt 21 and is supplied with a primary transfer voltage. As the primary transfer voltage, a direct-current voltage indicating a polarity opposite to the charging polarity of the toner is supplied from the power supply device (not shown).

The drum cleaning device 16 includes a container-shaped main body 160 that partially opens, a cleaning plate 161 that is disposed to be in contact with the peripheral surface of the photoconductive drum 11 after the primary transfer at a required pressure and removes and cleans deposits such as residual toner, a delivery member 162 such as a screw auger that recovers the deposits such as toner removed by the cleaning plate 161 and transports the deposits for delivery to a recovery system (not shown), and the like. As the cleaning plate 161, a plate-shaped member (for example, a blade) made of a material such as rubber is used.

As shown in FIG. 1, the intermediate transfer device 20 is disposed to be present at a position above each image creating device 10 (Y, M, C, K). The intermediate transfer device 20 includes an intermediate transfer belt 21 that rotates in a direction indicated by arrow B while passing through a primary transfer position between the photoconductive drum 11 and the primary transfer device 15 (primary transfer roll), a plurality of belt support rolls 22 to 27 that hold the intermediate transfer belt 21 in a desired state from an inner surface thereof and rotatably support the intermediate transfer belt 21, a secondary transfer device 30 serving as an example of a secondary transfer section that is disposed on an outer peripheral surface (image holding surface) side of the intermediate transfer belt 21 supported by the belt support roll 25 and secondarily transfers an toner image on the intermediate transfer belt 21 to the recording paper 5, and a belt cleaning device 28 that removes and cleans deposits such as toner and paper dust remaining on and adhering to the outer peripheral surface of the intermediate transfer belt 21 after passing through the secondary transfer device 30.

As the intermediate transfer belt 21, for example, an endless belt made of a material in which a resistance modifier such as carbon black is dispersed in a synthetic resin such as a polyimide resin or a polyamide resin is used.

Additionally, the belt support roll 22 is configured as a drive roll that is rotationally driven by the drive device (not shown) that also serves as a counter roll of the belt cleaning device 28, the belt support roll 23 is configured as a face-out roll that forms an image forming surface of the intermediate transfer belt 21, the belt support roll 24 is configured as a tension applying roll that applies tension to the intermediate transfer belt 21, the belt support roll 25 is configured as a counter roll that faces the secondary transfer device 30, and the belt support rolls 26 and 27 are configured as driven rolls that support the traveling position of the intermediate transfer belt 21.

As shown in FIG. 1, the secondary transfer device 30 is a contact type transfer device including a secondary transfer roll 31, which rotates in contact with a peripheral surface of the intermediate transfer belt 21 and is supplied with a secondary transfer voltage, at the secondary transfer position that is an outer peripheral surface portion of the intermediate transfer belt 21 supported by the belt support roll 25 in the intermediate transfer device 20. Additionally, a direct-current voltage showing the opposite polarity or the same polarity as the charging polarity of the toner is supplied to the secondary transfer roll 31 or the belt support roll 25 of the intermediate transfer device 20 from the power supply device (not shown) as the secondary transfer voltage.

The fixing device 40 is configured such that a heating belt 42 that is rotated in a direction indicated by an arrow and heated by a heating section such that the surface temperature is maintained at a predetermined temperature, a pressure roll 43 or the like that is in contact with the heating belt 42 at a predetermined pressure and rotates in a driven manner substantially in an axial direction of the heating belt 42, and the like are disposed inside the housing 41 in which an introduction port and an ejection port of the recording paper 5 are formed. In the fixing device 40, a contact portion where the heating belt 42 and the pressure roll 43 are in contact with each other is a fixing treatment portion that performs a required fixing treatment (heating and pressurizing). In addition, the fixing device 40 will be described in detail below.

The paper feed device 50 is disposed to be present at a position below the image creating device 10 (Y, M, C, K). The paper feed device 50 includes a single (or a plurality of) paper accommodation body 51 that accommodates the recording paper 5 of a desired size, type, or the like in a loaded state, and delivery devices 52 and 53 that deliver recording paper 5 sheet by sheet from the paper accommodation body 51. The paper accommodation body 51 is attached so that the paper accommodation body 51 can be pulled out to a front side (a side surface facing a user during operation) of the apparatus body 1*a*, for example.

Examples of the recording paper 5 include thin paper such as plain paper and tracing paper, OHP sheets, or the like, which are used in electrophotographic copying machines and printers. In order to further improve the smoothness of an image surface after fixing, for example, it is preferable that the surface of the recording paper 5 is as smooth as possible. For example, coated paper in which the surface of plain paper is coated with resin or the like, for example, so-called thick paper such as art paper for printing, or the like having a relatively large basis weight can also be used.

A paper feed transport route 56 including a single or a plurality of paper transport roll pairs 54 and transport guides 55, which transport the recording paper 5 delivered from the paper feed device 50 to the secondary transfer position, is provided between the paper feed device 50 and the secondary transfer device 30. The paper transport roll pair 54 disposed at a position immediately before the secondary transfer position in the paper feed transport route 56 is configured as, for example, a roll (registration roll) that adjusts the transport timing of the recording paper 5. Additionally, a paper transport route 57 for transporting the recording paper 5 after the secondary transfer, which is delivered from the secondary transfer device 30, to the fixing device 40 is provided between the secondary transfer device 30 and the fixing device 40. Moreover, an ejection transport route 59 including a paper ejection roll pair 59*a* for ejecting the recording paper 5 after fixing, which is delivered from the fixing device 40 by an outlet roll 36, to a paper ejection portion 58 on an upper portion of the apparatus body 1*a* is provided in a portion of the image forming apparatus 1 near the paper ejection port formed in the apparatus body 1*a*.

Reference sign 1200 in FIG. 1 indicates a control device that comprehensively controls the operation of the image forming apparatus 1. The control device 200 includes a central processing unit (CPU), a read only memory (ROM), a random access memory (RAM) (not shown), a bus for connecting the CPU, the ROM, and the like to each other, a communication interface, and the like. Additionally, reference sign 201 indicates a communication unit in which the image forming apparatus 1 communicates with an external device, and reference sign 202 indicates an image processing unit that processes image information input via the communication unit 201.

Operation of Image Forming Apparatus

Hereinafter, the basic image forming operation by the image forming apparatus 1 will be described.

Here, first, the operation in the full-color mode in which a full-color image configured by combining toner images of four colors (Y, M, C, K) is formed using the four image creating devices 10 (Y, M, C, K) will be is described.

In a case where the image forming apparatus 1 receives image information and request command information for a full-color image forming operation (print) from a personal computer, an image reading device, or the like (not shown) via the communication unit 201, the control device 200 starts the four image creating devices 10 (Y, M, C, K), the intermediate transfer device 20, the secondary transfer device 30, the fixing device 40, and the like.

Then, in each image creating device 10 (Y, M, C, K), as shown in FIG. 1, each photoconductive drum 11 first rotates in the direction indicated by the arrow A, and each charging device 12 charges the surface of the photoconductive drum 11 to a required polarity (negative polarity in Exemplary Embodiment 1) and a required potential. Subsequently, the exposure device 13 irradiates the surface of the photoconductive drum 11 after charging with the light emitted on the basis of image signals obtained by converting the image information input to the image forming apparatus 1 into each color component (Y, M, C, K) by the image processing unit 202, and forms an electrostatic latent image of each color component configured with a required potential difference on the surface thereof.

Subsequently, each image creating device 10 (Y, M, C, K) supplies a toner of a corresponding color (Y, M, C, K) charged with a required polarity (negative polarity) from the developing rolls 141 to the electrostatic latent image of each color component formed on the photoconductive drum 11 and causes the toner to electrostatically adhere to the electrostatic latent image to development. By virtue of this development, the electrostatic latent images of the respective color components formed on the respective photoconductive drums 11 are visualized as toner images of four colors (Y, M, C, K) developed with the toners of the corresponding colors.

Subsequently, in a case where the toner image of each color formed on the photoconductive drum 11 of each image creating device 10 (Y, M, C, K) is transported to the primary transfer position, the primary transfer device 15 (Y, M, C, K) primarily transfers the toner image of each color in a state in which the toner image of each color is sequentially superimposed on the intermediate transfer belt 21 while rotating in the direction indicated by the arrow B of the intermediate transfer device 20.

Additionally, in each image creating device 10 (Y, M, C, K) in which the primary transfer is completed, the drum cleaning device 16 removes deposits to scrape off the deposits and cleans the surface of the photoconductive drum 11. Accordingly, each image creating device 10 (Y, M, C, K) is in a state in which the next image creating operation can be performed.

Subsequently, the intermediate transfer device 20 holds the toner image that is primarily transferred by the rotation of the intermediate transfer belt 21 and transports the toner image to the secondary transfer position. Meanwhile, in the paper feed device 50, the required recording paper 5 is delivered to the paper feed transport route 56 in conformity with the image creating operation. In the paper feed transport route 56, the paper transport roll pair 54 serving as the registration roll delivers and supplies the recording paper 5 to the secondary transfer position in conformity with a transfer timing.

At the secondary transfer position, the secondary transfer device 30 collectively secondarily transfers the toner image on the intermediate transfer belt 21 to the recording paper 5. Additionally, in the intermediate transfer device 20 in which the secondary transfer is completed, the belt cleaning device 28 removes and cleans the deposits such as toner remaining on the surface of the intermediate transfer belt 21 after the secondary transfer.

Subsequently, the recording paper 5 on which the toner image is secondarily transferred is peeled off from the intermediate transfer belt 21 and then transported to the fixing device 40 via the paper transport route 57. In the fixing device 40, by introducing and passing the recording paper 5 after the secondary transfer into and through the contact portion between the rotating heating belt 42 and the pressure roll 43, the required fixing treatment (heating and pressurizing) is performed, and an unfixed toner image is fixed on the recording paper 5. Finally, the recording paper 5 after the fixing is completed is ejected to, for example, the paper ejection portion 58 installed in the upper portion of the apparatus body 1*a* by the paper ejection roll pair 59*a*.

By the above operation, the recording paper 5 on which the full-color image configured by combining the toner images of four colors is formed is output.

Configuration of Fixing Device

Figure 2:
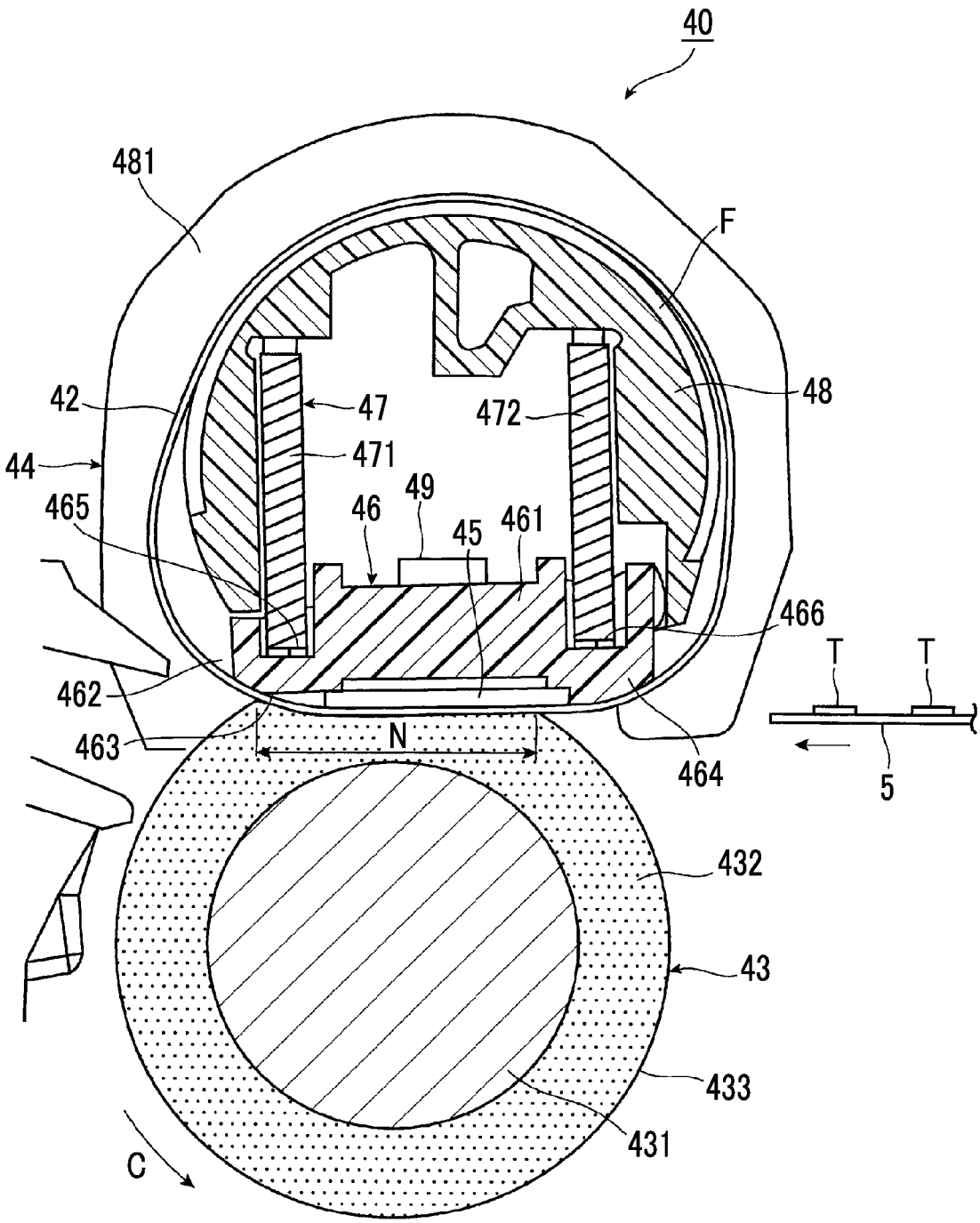
FIG. 2 is a cross-sectional configuration diagram showing the fixing device according to Exemplary Embodiment 1 of the present invention.

FIG. 2 is a cross-sectional configuration diagram showing the fixing device according to Exemplary Embodiment 1.

As shown in FIG. 2, the fixing device 40 generally includes a heating unit 44 having the heating belt 42 serving as an example of a rotating endless belt, and the pressure roll 43 serving as an example of a rotating body being in pressure contact with the heating unit 44. A fixing nip portion N serving as an example of a pressure contact portion, which is a region through which the recording paper 5 serving as an example of a recording medium holding an unfixed toner image T serving as an example of an unfixed image passes, is formed between the heating belt 42 and the pressure roll 43. In addition, the recording paper 5 is transported with a center in a direction intersecting a transport direction as a reference (so-called center registration).

As shown in FIG. 1, the fixing device 40 is disposed such that the heating belt 42 and the pressure roll 43 face each other in a substantially horizontal direction in order to perform the fixing treatment on the recording paper 5 transported in an extension direction, in the paper transport route 57 along which the recording paper 5 is transported from a lower side toward an upper side in a vertical direction. However, in FIG. 2, for convenience, the heating belt 42 and the pressure roll 43 are shown in an upward-downward direction.

As shown in FIG. 2, the heating unit 44 includes the heating belt 42, a ceramic heater 45 serving as an example of a planar heat-generating section (planar heat-generating element) that is disposed inside the heating belt 42 and heats the heating belt 42, a holding member 46 serving as an example of a holding section that is also disposed inside the heating belt 42 and holds the ceramic heater 45 to be in pressure contact with the surface of the pressure roll 43 via the heating belt 42, a support member 47 serving as an example of a support section that is disposed inside the heating belt 42 and supports the holding member 46 to be in pressure contact with the pressure roll 43, and a guide member 48 that is disposed in the longitudinal direction inside the heating belt 42 and rotatably guides the heating belt 42.

In addition, in the ceramic heater 45 serving as an example of the planar heat-generating section, a heat-generating portion itself is not necessarily planar. Even in a case where the heat-generating portion may be linearly formed, a lower end surface (heating surface) of the ceramic heater 45 that heats the heating belt 42 may be planar. Additionally, the lower end surface (heating surface) of the ceramic heater 45 is not necessarily a flat surface and may have a curved surface shape.

Figure 3:
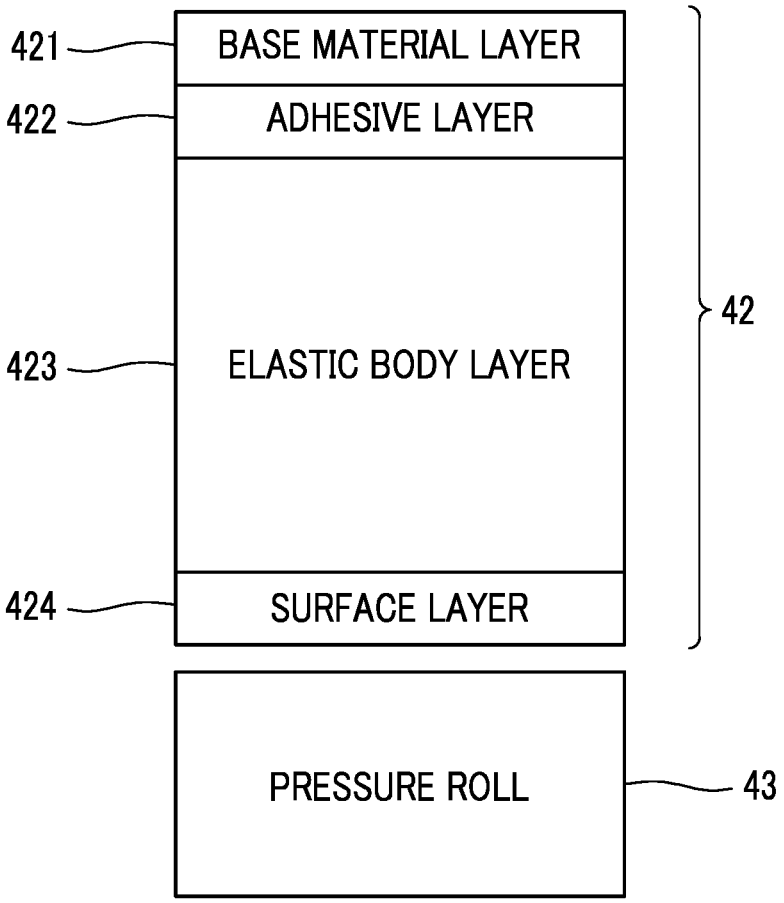
FIG. 3 is a cross-sectional configuration diagram showing a heating belt.

The heating belt 42 is made of a material having flexibility and is configured as an endless belt in which a free shape thereof is thin-walled cylindrical in a state before mounting. As shown in FIG. 3, the heating belt 42 has a base material layer 421 that is disposed on the ceramic heater 45 side, an elastic body layer 423 that is coated on the surface of the base material layer 421 via an adhesive layer 422, and a surface layer 424 that is coated on the surface of the elastic body layer 423 directly or via an adhesive layer (not shown). The base material layer 421 is formed using a heat-resistant synthetic resin such as polyimide, polyamide, or polyimideamide as a component. The elastic body layer 423 is made of a heat-resistant elastic body such as silicone rubber or fluororubber. The surface layer 424 is formed of perfluoroalkoxyalkane (PFA), polytetrafluoroethylene (PTFE), or the like. The thickness of the heating belt 42 can be set to, for example, about 50 μm to 200 μm.

The base material layer 421 contains, as necessary, a heat-resistant synthetic resin such as polyimide, polyamide, or polyimideamide as a component, and a filler such as carbon nanotubes, carbon fibers, or glass fibers is blended to improve the characteristics such as the thermal conductivity of the heating belt 42. As the filler, for example, the carbon nanotubes are desirable from the viewpoint of high thermal conductivity, low dynamic friction coefficient, and wear resistance.

Figure 4:
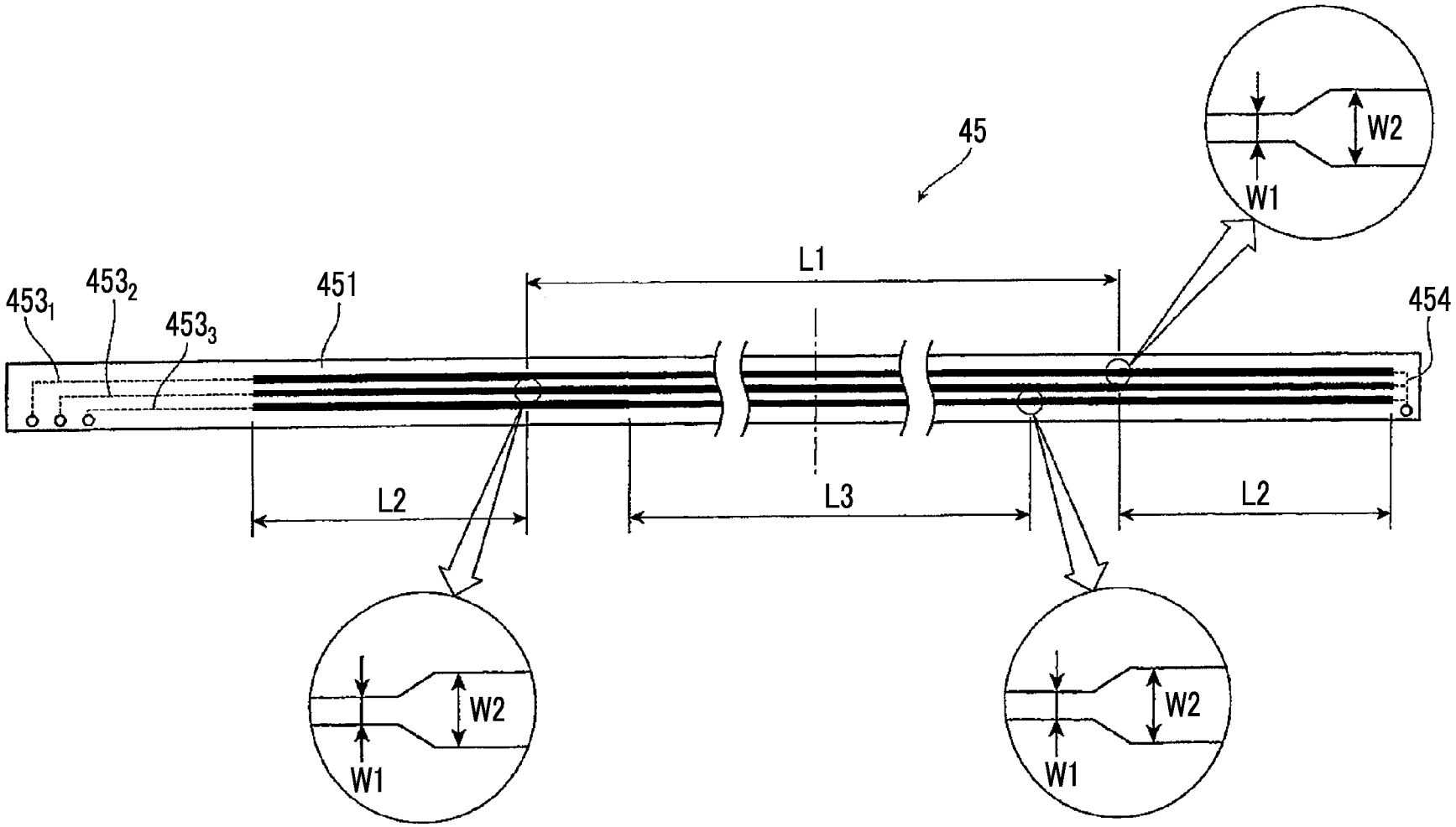
FIG. 4 is a plan configuration diagram showing a heat-generating portion of a ceramic heater.
Figure 5:
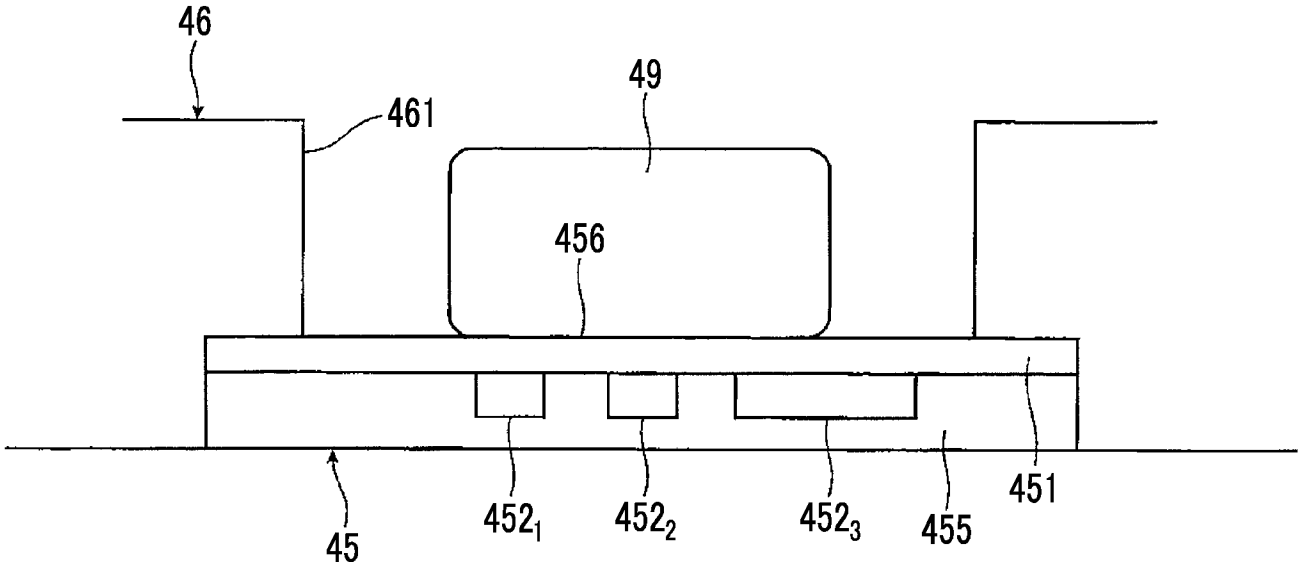
FIG. 5 is a cross-sectional configuration diagram showing major parts of the fixing device according to Exemplary Embodiment 1 of the present invention.

As shown in FIGS. 4 and 5, the ceramic heater 45 includes a ceramic substrate 451, a plurality of first to third heat-generating portions $\mathbf{452}_1$ to $\mathbf{452}_3$ linearly formed in the longitudinal direction on the surface of the substrate 451, first to third electrodes $453_1$ to $453_3$ for individually energizing the first to third heat-generating portions $452_1$ to $452_3$, a common electrode 454 that commonly energizes the other end portions of the first to third heat-generating portions $452_1$ to $452_3$, and a coating layer 455 made of glass or the like that is coated on the surfaces of at least the first to third heat-generating portions $452_1$ to $452_3$.

The holding member 46 is made of, for example, a heat-resistant synthetic resin integrally molded into a required shape by injection molding or the like. Examples of the heat-resistant synthetic resin include liquid crystal polymer (LCP), polyetheretherketone (PEEK), polyphenylene sulfide (PPS), polyethersulfone (PES), polyamideimide (PAI), polytetrafluoroethylene (PTFE), polychlorotrifluoroethylene (PCTFE), polyvinylidene fluoride (PVDF), or a composite material thereof.

The holding member 46 has a support frame portion 461 that supports the ceramic heater 45 to pressurize the pressure roll 43 via the heating belt 42 at the fixing nip portion N and is made of an elongated rectangular frame corresponding to the planar shape of the ceramic heater 45 (refer to FIG. 5). The holding member 46 is disposed to be longer than the total length in the longitudinal direction of the heating belt 42.

As shown in FIG. 2, the holding member 46 is provided with a first guide portion 462 that is formed in a curved cross-sectional shape and guides the heating belt 42 to the fixing nip portion N on the upstream side of the fixing nip portion N in a rotational direction of the heating belt 42. A lower end surface 463 of the holding member 46 is formed in a planar shape. The lower end surface 463 of the holding member 46 located on the downstream side in the rotational direction of the heating belt 42 is formed to form substantially the same plane as the surface of the ceramic heater 45. Additionally, the holding member 46 has a second guide portion 464 provided at a position adjacent to the downstream side of the fixing nip portion N in the rotational direction of the heating belt 42. The second guide portion 464 guides the heating belt 42 to be in contact with the inner surface of the heating belt 42 that has passed through the fixing nip portion N and return to a substantially free shape, and has a cross-sectional shape formed in a curved cross-sectional shape.

Additionally, abutment portions 465 and 466 that hold the support member 47 in a state where the tips of first and second vertical plate portions 471 and 472 of the support member 47 abut against the surface of the holding member 46 opposite to the fixing nip portion N, are provided on the upstream side and the downstream side in the rotational direction of the heating belt 42.

As shown in FIG. 2, the support member 47 is made of, for example, a metallic plate material such as stainless steel, aluminum, or steel. The support member 47 includes the first and second vertical plate portions 471 and 472 that are respectively disposed substantially perpendicular to the surface of the ceramic heater 45 on the upstream side and the downstream side of the fixing nip portion N in the rotational direction of the heating belt 42.

The guide member 48 is formed in a substantially U-shape that is directed downward in the longitudinal direction of the heating belt 42 inside the heating belt 42. The guide member 48 is attached to the support member 47 together with the holding member 46. A lubricant holding member F made of felt or the like impregnated with a lubricant such as silicone oil or grease is provided on an outer peripheral surface of the guide member 48 in order to reduce the sliding resistance between the heating belt 42 and the ceramic heater 45.

Additionally, flange portions 481, which regulate the movement of the heating belt 42 in the longitudinal direction in a direction intersecting the movement direction of the heating belt 42, are respectively provided at both end portions of the guide member 48 in the longitudinal direction.

The temperature of the fixing nip portion N of the heating belt 42 is detected by a temperature sensor 49 that is disposed to be in contact with the surface of the ceramic heater 45 opposite to the fixing nip portion N. As described above, the ceramic heater 45 includes the first to third heat-generating portions $452_1$ to $452_3$ having different heat-generating regions in the longitudinal direction. For that reason, a plurality (for example, three) of temperature sensors 49 are disposed in the longitudinal direction of the ceramic heater 45 in correspondence with the first to third heat-generating portions $452_1$ to $452_3$. The heating belt 42 is heated such that the fixing nip portion N reaches a required fixing temperature (for example, about 200° C. to 230° C.) depending on the size the recording paper 5 by controlling the energization of the first to third heat-generating portions $452_1$ to $452_3$ of the ceramic heater 45 on the basis of the detection result of the temperature sensor 49 by a temperature control circuit (not shown).

As shown in FIG. 2, the pressure roll 43 has a columnar or cylindrical core metal 431 made of metal such as stainless steel, aluminum, or iron (thin-walled high-tension steel pipe), an elastic body layer 432 made of a heat-resistant elastic body such as silicone rubber or fluororubber relatively thickly coated at an outer periphery of the core metal 431, and a release layer 433 made of polytetrafluoroethylene (PTFE), perfluoroalkoxyalkane (PFA), or the like relatively thinly coated on the surface of the elastic body layer 432. In addition, as necessary, a heating section (heating source) including a halogen lamp or the like may be disposed inside the pressure roll 43.

Both end portions of the core metal 431 in the longitudinal direction (axial direction) of the pressure roll 43 are rotatably supported by a frame of a device housing (not shown) of the fixing device 40 via a bearing member. The pressure roll 43 is in pressure contact with the heating unit 44 at a required pressure. The pressure roll 43 is rotationally driven at a required speed in a direction of arrow C by the drive device via a drive gear (not shown) attached to one end portion in an axial direction of the core metal 431 that also serves as a rotation shaft. In addition, the heating belt 42 is in pressure contact against the rotationally driven pressure roll 43 and rotates in a driven manner.

Meanwhile, in the fixing device 40 configured as described above, as shown in FIG. 6, the ceramic heater 45 is formed by integrally forming a plurality of ceramic heaters 45 and then separating adjacent ceramic heaters 45 from each other.

Figure 7:
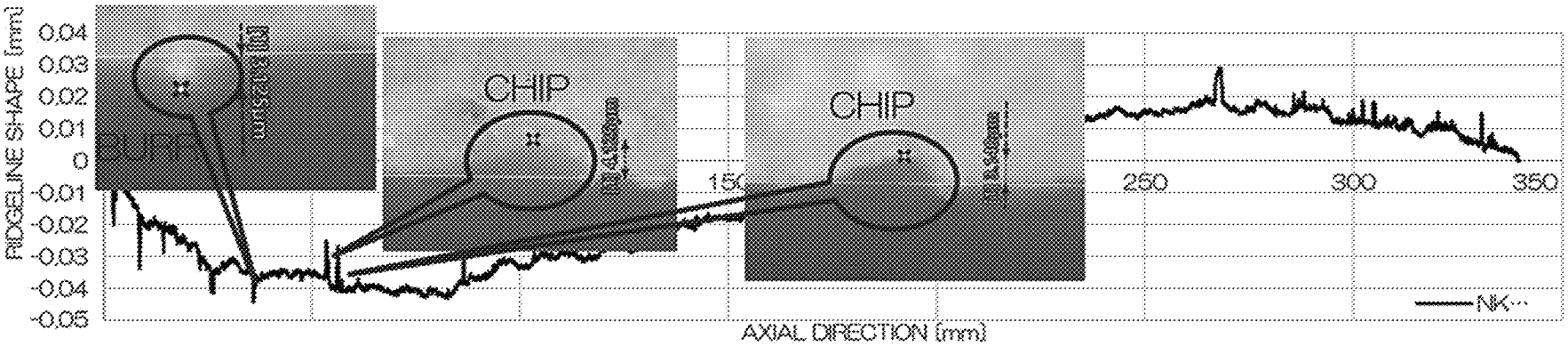
FIG. 7 is an enlarged view showing the shape of an edge portion of the ceramic heater.

For that reason, as shown in an enlarged view in FIG. 7, minute chips and burrs are present at the corner portions of the surface of each ceramic heater 45 in the width direction that are in contact with the inner surface of the heating belt 42.

In this way, in a case where minute chips or burrs are present at the corner portions of the surface of the ceramic heater 45 in the width direction, there are technical challenges in which the inner surface of the heating belt 42 is damaged due to the minute chips or burrs on the surface of the ceramic heater 45 while the heating belt 42 moves orbitally, and the lifespan of the heating belt 42 decreases.

For that reason, in order to address such technical challenges, the related-art fixing device 40 configured such that the shape of the end face edge portion of the sliding portion of the protruding heating element is R0.2 or more has already been proposed (JP2006-292867A).

However, in the related-art fixing device 40, it has been clarified by the present inventors that the following technical challenges newly occur in a case where the shape of the end face edge portion of the sliding portion of the protruding heating element is configured to be R0.2 or more.

As shown in FIG. 1, the recording paper 5 to which the toner image T made of substantially spherical fine powder is transferred at the secondary transfer position is transferred enters the fixing nip portion N of the fixing device 40 with the rotation of the heating belt 42.

Figure 8:
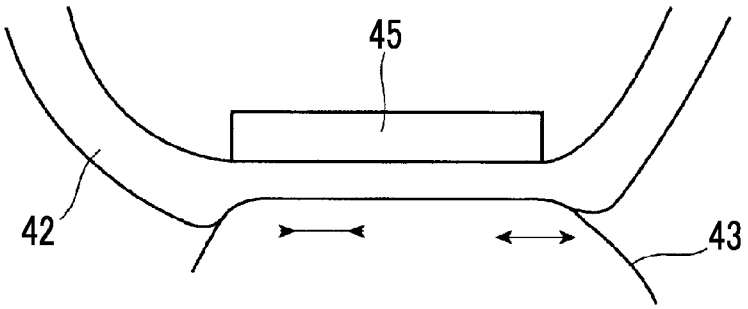
FIG. 8 is a schematic view showing distortion of a heating belt in a fixing nip portion.

In the fixing nip portion N, the pressure roll 43 is in pressure contact with the ceramic heater 45 via the recording paper 5 holding the toner image T and the heating belt 42. For that reason, as shown in FIG. 8, the elastic body layer 432 formed on the surface of the pressure roll 43 is in pressure contact with the surface of the ceramic heater 45 and thereby deformed into a substantially planar shape from a circular cross-sectional shape that is an original shape thereof. As a result, the elastic body layer 432 on the surface of the pressure roll 43 is compressed and shortened in the circumferential direction by deforming a peripheral length, which is a length in the circumferential direction, in a substantially planar shape from a circular cross-sectional shape. Along with this, the elastic body layer 423 of the heating belt 42, which is in pressure contact with the surface of the ceramic heater 45 together with the pressure roll 43, is also compressed in the length in the circumferential direction, similarly to the elastic body layer 432 of the pressure roll 43. Moreover, the toner image held on the recording paper 5, which is in contact with the surface of the heating belt 42, also passes through the fixing nip portion N in a compressed state in the movement direction.

That is, the toner image held on the recording paper 5 is heated and pressurized to a temperature equal to or higher than the glass transition temperature by the heat of the ceramic heater 45 and the pressing force from the pressure roll 43 while passing through the fixing nip portion N and is in a softened and molten state, and adjacent toner particles are agglomerated in a compressed state in the movement direction and pass through the fixing nip portion N.

Thereafter, the toner image held on the recording paper 5 passes through the fixing nip portion N, and then the state of being compressed in the movement direction is abruptly eliminated, and the toner image agglomerated by heating and pressurizing is in a stretched state in the movement direction. Accordingly, a good quality image is fixed on the recording paper 5.

Figure 9:
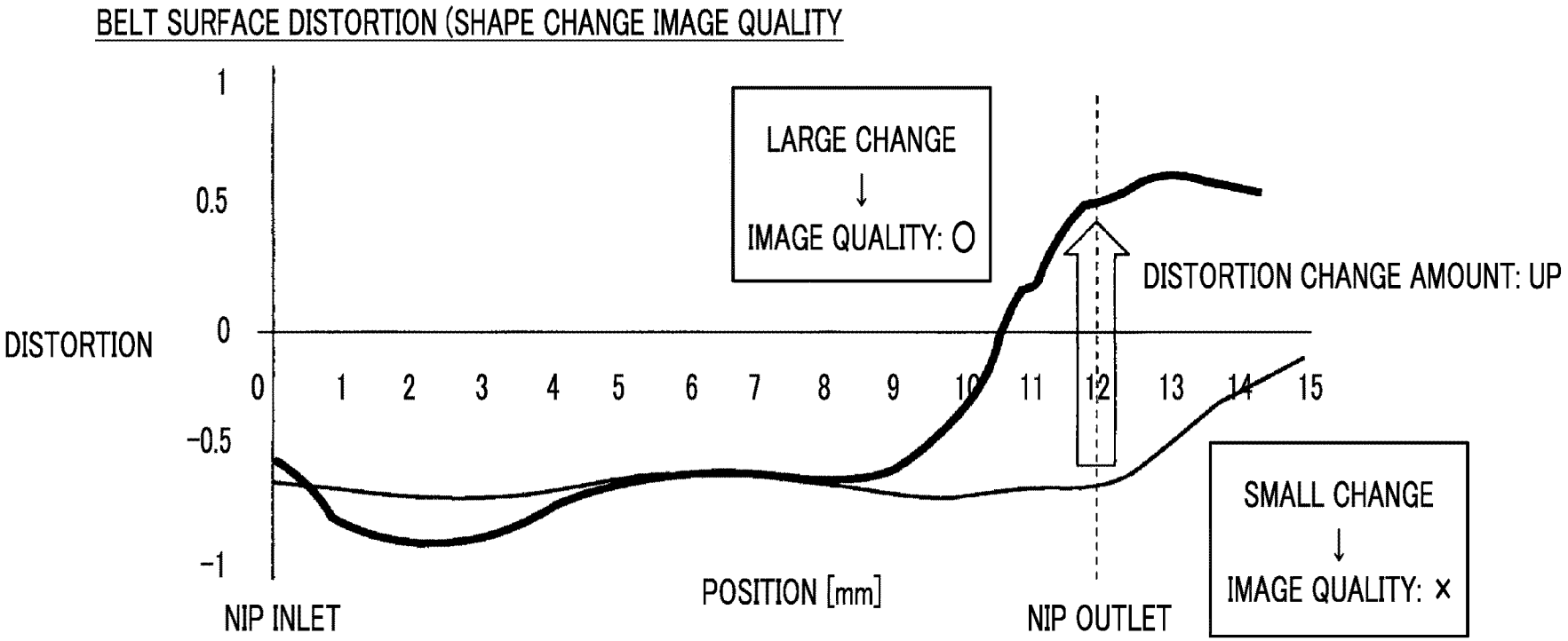
FIG. 9 is a graph showing a relationship between the position of the fixing nip portion and the distortion on the surface of the heating belt.

In contrast, in the related-art fixing device 40, in a case where the shape of the end face edge portion of the sliding portion of the protruding heating element is configured to be R0.2 or more, a rounded shape having a large curvature radius of R0.2 or more is formed at the corner portion of the ceramic heater 45 that is the heating element. Therefore, as shown in FIGS. 8 and 9, it has been clarified by the research of the present inventors that new technical challenges newly occur in which the stretching action in the movement direction after the recording paper 5 has passed through the fixing nip portion N does not act sufficiently and it is difficult to obtain a good quality image.

Thus, in the fixing device 40 according to Exemplary Embodiment 1 is configured to include a planar heat-generating section in which at least a downstream end portion in a movement direction of the belt is in pressure contact with a rotating body via a pressure contact portion, and a cross-sectional shape of a downstream edge portion being in contact with an inner surface of the belt is formed in a curved shape having a curvature radius of 0.01 mm or more and 0.2 mm or less or in a shape having an edge portion cut out over the dimension. For example, preferably, the cross-sectional shape of the downstream edge portion being in contact with the inner surface of the belt is formed into a curved shape having a curvature radius of less than 0.2 mm or in a shape in which the edge portion is cut out over the dimension.

Figure 6:
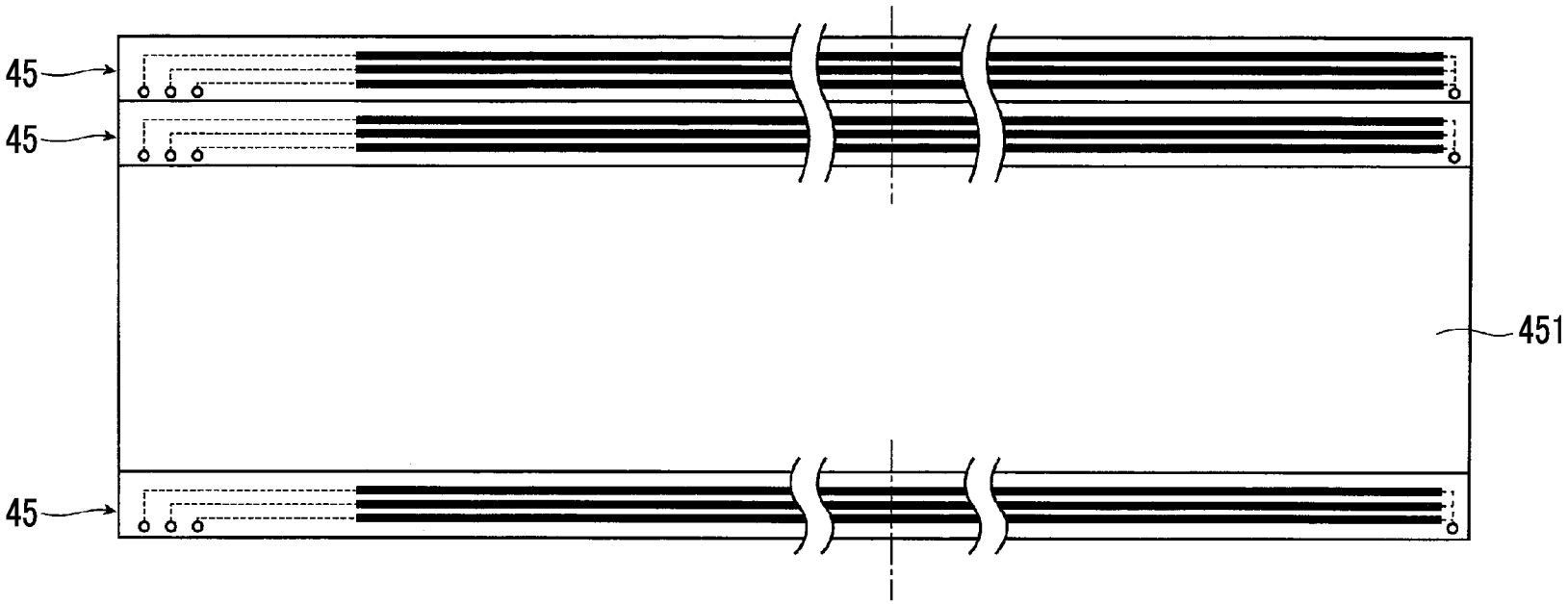
FIG. 6 is a schematic view showing a manufacturing process of the ceramic heater.

As shown in FIG. 6, the ceramic heater 45 is manufactured as a plurality of the ceramic heaters 45 are simultaneously formed on the same ceramic substrate 451 and then an individual ceramic heater 45 is separated from another ceramic heater 45 adjacent thereto in the width direction.

In this case, in each ceramic heater 45, as shown in FIG. 7, minute chips or burrs are inevitably generated at the corner portions formed with another adjacent ceramic heater 45 located on the surface thereof.

Figures 10, 11:
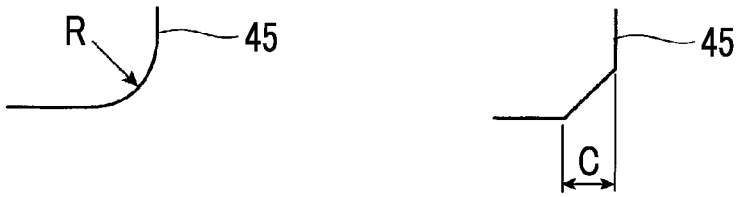
FIG. 10 is a cross-sectional view showing the shape of the edge portion of the ceramic heater.
FIG. 11 is a chart showing experimental results.

For that reason, as shown in FIG. 10, each ceramic heater 45 is processed such that the cross-sectional shape of the downstream edge portion that is in contact with the inner surface of the heating belt 42 is a rounded shape or a C-shape by machining such as polishing or cutting or chemical treatment such as etching.

In this case, the present inventors conducted various experiments in which a longer lifespan of the above-described heating belt 42 and a good quality image can be realized in a case where the cross-sectional shape of the edge portion located on the downstream side being in contact with the inner surface of the heating belt 42 of each ceramic heater 45 is processed to have a rounded shape or a C-shape or processed to have an rounded shape to a C-shape to some extent.

In the experiments, in a case where the cross-sectional shape of the edge portion of the ceramic heater 45 was processed into a rounded shape, the curvature radius of the rounded shape was changed to 0.005 mm, 0.01 mm, 0.1 mm, 0.2 mm, and 0.3 mm, the lifespan of the heating belt 42 was measured, and the quality of an image fixed on the recording paper 5 was visually checked. In addition, the size of the rounded shape in the cross-sectional shape of the edge portion of the ceramic heater was measured using a laser shape measuring machine "ROLL2000" of Asaka Riken Co., Ltd.

In order to maintain the function of the heating belt 42 without breakage or the like until the required lifespan, it is necessary to suppress damage to the inner surface of the heating belt caused by burrs or chips on the heater edge portion. The depth of circumferential scratches on the inner surface of a heating belt rubbed by a ceramic heater after passing 50,000 sheets of A4 size plain paper through a heated fixing nip portion was measured with "VK-K100" made by Keyence Corp. In a case where the depth was equal to or less than the standard with the depth of 3 μm as a basis, the required lifespan could be achieved, and in a case where the depth was larger than the standard, the required lifespan could be achieved.

In addition, the quality of the image fixed on the recording paper 5 was evaluated as O in a case where there was no problem according to the image quality evaluation standard adopted in the applicant's company, was evaluated as Δ in a case where there was no problem in actual use although a slight deterioration in image quality was observed, and was evaluated as X in a case where there was a problem in actual use due to a remarkable deterioration in image quality.

FIG. 11 is a chart showing the results of the above experiments.

As is clear from FIG. 11, in a case where the rounded shape of the edge portion of the ceramic heater 45 was 0.005 mm, the image quality was good. However, the decrease in the lifespan of the heating belt 42 occurred, and the belt reliability was determined as X.

Additionally, in a case where the rounded shape of the edge portion of the ceramic heater 45 was 0.01 mm to 0.2 mm, the belt reliability and the image quality were good. However, in a case where the rounded shape was 0.2 mm, a slight deterioration in the image quality was observed.

For that reason, the rounded shape of the edge portion of the ceramic heater 45 is, for example, desirably in a range of 0.01 mm to 0.2 mm. However, in particular, a range of 0.01 mm to 0.1 mm is more desirable.

Meanwhile, in a case where the rounded shape of the edge portion of the ceramic heater 45 was 0.3 mm, the belt reliability was good. However, the deterioration in the image quality was remarkable observed, and the image quality was determined to be unacceptable.

Operation of Fixing Device

In the fixing device according to Exemplary Embodiment 1, compared to a case where the cross-sectional shape of the downstream edge portion of the planar heat-generating section in the movement direction of the belt that comes into pressure contact with the inner surface of the belt is formed in an arc shape having a curvature radius of 0.2 mm or more, it is possible to make a longer lifespan of the belt and the improvement in the image quality compatible with each other.

That is, as shown in FIG. 2, the fixing device 40 according to Exemplary Embodiment 1 perform the fixing treatment as the recording paper 5 holding the unfixed toner image T is introduced into the fixing nip portion N and thereby heated and pressurized by the heat from the ceramic heater 45 and the pressing force of the pressure roll 43 via he heating belt 42.

In this case, in the fixing nip portion N, the pressure roll 43 is in pressure contact with the ceramic heater 45 via the recording paper 5 holding the toner image T and the heating belt 42. For that reason, as shown in FIG. 8, the elastic body layer 432 formed on the surface of the pressure roll 43 is in pressure contact with the surface of the ceramic heater 45 and thereby deformed into a substantially planar shape from a circular cross-sectional shape that is an original shape thereof. As a result, the elastic body layer 432 on the surface of the pressure roll 43 is compressed and shortened in the circumferential direction by deforming a peripheral length, which is a length in the circumferential direction, in a substantially planar shape from a circular cross-sectional shape. Along with this, the elastic body layer 423 of the heating belt 42, which is in pressure contact with the surface of the ceramic heater 45 together with the pressure roll 43, is also compressed in the length in the circumferential direction, similarly to the elastic body layer 432 of the pressure roll 43. Moreover, the toner image held on the recording paper 5, which is in contact with the surface of the heating belt 42, also passes through the fixing nip portion N in a compressed state in the movement direction.

That is, the toner image held on the recording paper 5 is heated and pressurized to a temperature equal to or higher than the glass transition temperature by the heat of the ceramic heater 45 and the pressing force from the pressure roll 43 while passing through the fixing nip portion N and is in a softened and molten state, and adjacent toner particles are agglomerated in a compressed state in the movement direction and pass through the fixing nip portion N.

Thereafter, the toner image held on the recording paper 5 passes through the fixing nip portion N, and then the state of being compressed in the movement direction is abruptly eliminated, and the toner image agglomerated by heating and pressurizing is in a stretched state in the movement direction. Accordingly, a good quality image is fixed on the recording paper 5.

Meanwhile, in the fixing device 40 according to Exemplary Embodiment 1, the shape of the edge portion of the downstream end portion in the movement direction of the heating belt 42 of the ceramic heater 45 is configured to in a range of 0.01 mm to 0.2 mm.

For that reason, as shown in FIG. 7, no minute chips or burrs are present on the edge portion of the downstream end portion of the ceramic heater 45 in the movement direction of the heating belt 42. Thus, the heating belt 42 that is in contact with the edge portion of the ceramic heater 45 is not damaged, and a longer lifespan of the heating belt 42 is possible.

Additionally, in the fixing device 40 according to Exemplary Embodiment 1, the shape of the edge portion of the ceramic heater 45 satisfies the range of 0.01 mm to 0.2 mm.

For that reason, the quality of the toner image T fixed on the recording paper 5 is maintained well without the stretching action not acting sufficiently in the movement direction after the recording paper 5 has passed through the fixing nip portion N and making it difficult to obtain a good quality image as in the case where the edge portion of the ceramic heater 45 is R0.2 or more.

In addition, in the above exemplary embodiments, the case where the ceramic heater is used as the planar heat-generating section has been described, but the planar heat-generating section is not limited to the ceramic heater, and anything that generates heat literally in a planar manner at the fixing nip portion N may be used.

Additionally, in the above-described exemplary embodiments, the case where the pressure roll is used as the pressurizing section has been described, but a pressure belt may be used as the pressurizing section.

Additionally, although the present invention has been described with the electrophotographic image forming apparatus, the present invention is not limited to the electrophotographic image forming apparatus. For example, it is also possible to apply the present invention to an ink jet type image forming apparatus or the like in which an unfixed ink image is fixed on paper in contact with the paper transported while holding an image of an undried layer with ink (an unfixed ink image).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable endless belt;

a planar heat-generating section in which at least a downstream end portion in a movement direction of the belt is in pressure contact with a rotating body via a pressure contact portion and a cross-sectional shape of a downstream edge portion being in contact with an inner surface of the belt is formed in a curved shape having a curvature radius of 0.01 mm or more and 0.2 mm or less or in a shape in which the downstream edge portion has a cut out; and a holding section that is disposed inside the belt and holds the planar heat-generating section to be in pressure contact with the rotating body, wherein the downstream end portion of the planar heat-generating section in the movement direction of the belt is located inside the pressure contact portion, and an upstream end portion of the planar heat-generating section in the movement direction of the belt is located outside the pressure contact portion.

2. The fixing device according to claim 1, wherein the downstream edge portion having the cut out comprises a plurality of corner portions.

3. The fixing device according to claim 1, wherein the planar heat-generating section comprises a plurality of planar heat-generating sections integrally formed in a direction intersecting a longitudinal direction of the planar heat-generating section.

4. The fixing device according to claim 3, wherein the downstream edge portion of the planar heat-generating section that is in contact with the inner surface of the belt is cut or polished.

5. An image forming apparatus comprising:

an image forming section that forms an image on a recording medium; and a fixing section that fixes the image formed on the recording medium, wherein the fixing device according to claim 1 is used as the fixing section.

6. A fixing device comprising:

a rotatable endless belt;

a planar heat-generating section in which at least a downstream end portion in a movement direction of the belt is in pressure contact with a rotating body via a pressure contact portion and a cross-sectional shape of a downstream edge portion being in contact with an inner surface of the belt is formed in a curved shape having a curvature radius of 0.01 mm or more and 0.2 mm or less or in a shape in which the downstream edge portion has a cut out; and a holding section that is disposed inside the belt and holds the planar heat-generating section to be in pressure contact with the rotating body, wherein the downstream end portion of the planar heat-generating section in the movement direction of the belt has a larger pressure contact amount with respect to the rotating body than an upstream end portion of the planar heat-generating section.

7. The fixing device according to claim 6, wherein the holding section is disposed by being displaced to an upstream side in a rotational direction of the rotating body.

* * * * *